United States Patent [19]

Gruber et al.

[11] Patent Number: 4,837,101

[45] Date of Patent: Jun. 6, 1989

[54] NEGATIVELY CHARGED COLORED TONER COMPOSITIONS

[75] Inventors: Robert J. Gruber, Pittsford; John F. Knapp, Fairport; Ronald J. Koch, Webster; Lawrence Floyd, Jr., Rochester, all of N.Y.

[73] Assignee: Xerox Corporation, Stamford, Conn.

[21] Appl. No.: 150,584

[22] Filed: Feb. 1, 1988

[51] Int. Cl.[4] ..... G03G 9/10

[52] U.S. Cl. ..... 430/109; 430/110

[58] Field of Search ..... 430/108, 109, 110

[56] References Cited

U.S. PATENT DOCUMENTS 4,513,074 4/1985 Nash et al. ..... 430/106.6
4,513,075 4/1985 Narusawa et al. ..... 430/108
4,564,573 1/1986 Morita et al. ..... 430/109
4,695,524 9/1987 Knapp et al. ..... 430/32

*Primary Examiner*—John L. Goodrow
*Attorney, Agent, or Firm*—E. O. Palazzo

[57] ABSTRACT

A negatively charged developer composition comprised of a toner composition with an average particle diameter of from about 4 to about 9 microns containing a mixture of styrene butadiene copolymers, and styrene methacrylate copolymers; pigment particles selected from the group consisting of cyan, magenta, yellow, red, blue, green, brown, and mixtures thereof; first external additive particles of colloidal silica; second external additive particles of fatty acid metal salts; and carrier particles comprised of a ferrite core with a polymeric coating thereover, which coating has dispersed therein conductive particles.

18 Claims, No Drawings

NEGATIVELY CHARGED COLORED TONER COMPOSITIONS

BACKGROUND OF THE INVENTION

This invention is generally directed to negatively charged colored toner and developer compositions useful in electrophotographic imaging and printing processes. More specifically, the present invention relates to negatively charged colored developer compositions with stable triboelectric characteristics, and excellent admix times containing therein certain polymers, first additive particles, and second additive particles. In one embodiment thus there are provided in accordance with the present invention negatively charged developer compositions comprised of styrene butadiene resin particles, first additive particles, second additive particles, colored pigment particles other than black, and carrier particles which consist of, for example, a core with a coating thereover. The aforementioned developers possess several advantages including stable triboelectric charging values for extended time periods exceeding, for example, 200,000 imaging cycles; improved admix characteristics, that is admix charging times in some instances of less than 60 seconds; and moreover the toner particles can be formulated with desired average particle diameters of from 4 to 9 microns. The aforementione developer compositions of the present invention are particularly useful in electrophotographic printing and imaging methods, especially xerographic processes wherein colored images with acceptable resolution and color intensity are generated. Accordingly, images obtained with the developer compositions of the present invention possess image uniformity, edge sharpness, and also the images are nongrainy.

Colored toner compositions are known; for example, there are illustrated in U.S. Pat. No. 4,604,338 positively charged colored toner compositions comprised of first resin particles; second crosslinked resin particles; colored pigment particles excluding black, and selected from cyan, yellow, magneta, brown, blue, and red; a low molecular weight wax; and certain charge enhancing additives. Further, there are described in U.S. Pat. No. 4,513,074 stable developer compositions comprised of first styrene methacrylate resin particles grafted with, or containing a low molecular weight wax; second resin particles of a styrene, acrylate, acrylonitrile terpolymer; pigment particles; colloidal silica additive particles; fatty acid salt additive particles; and uncoated ferrite carrier particles. In column 7, line 26, of this patent it is indicated that various suitable colorants may be incorporated into the developer, such as carbon black nigrosine dyes, and the like. Moreover, in column 5, line 31, of the U.S. Pat. No. 4,513,074 it is stated that the conductive developers illustrated have a number of suitable desirable properties, including a stable conductivity over extended time periods, wide toner concentration ranges, and insensitivity to certain relative humidities. Imaging advantages are illustrated in column 5, lines 35 to 39. In addition, the developers of the U.S. Pat. No. 4,513,074 possess other advantages, including stable triboelectric charging values, namely for example from about 10 to about 40 microcoulombs per gram, see column 5, lines 40 to 57.

In copending application U.S. Pat. No. 4,737,434 there are consistent high quality colored images with a stable two component developer comprised of first and second different polymer particles and blended flow aid additives. Toner particles with an average diameter of 8.5 microns are disclosed in the aforementioned copending application in Example I, page 10.

Also, in U.S. Pat. No. 4,695,524 there is disclosed a process for generating images with a two component magnetic developer, and wherein the toner composition has an average particle diameter of from about 6 to about 10 microns.

Illustrated in U.S. Pat. No. 4,513,075 are developers comprising a mixture of coated carrier particles, and a toner wherein the size of the toner particles is usually from about 5 to about 30 microns, reference column 4, lines 27 to 30. In column 4 of this patent, it is indicated that in order to make the toner color deep a bluish nigrosine dye is mixed to the binder resin. Moreover, a charge controlling agent can be added to the toner resin, reference column 4, lines 65 to 68, and column 5 of the 075 patent. As carrier particles, there are mentioned in this patent cores coated with a resin comprising a butadiene homopolymer with certain molecular weights, or a mixture of homopolymers and a styrene butadiene copolymer, reference column 3, lines 1 to 8.

Described in U.S. Pat. No. 4,564,573 are toners comprising a binder with at least 60 percent by weight of a styrene butadiene copolymer, which copolymer possesses certain characteristics, including a molecular weight of 100,000 with a ratio of at least 20. In column 8, line 21, of this patent there is disclosed the addition of pigments or dyes as well as other additives, such as components for controlling the electrostatic polarity with specific examples of colorants being outlined at column 8, line 31, including carbon black, aniline blue, chrome yellow, DuPont oil red, and the like. Additionally, in column 8, line 47, it is indicated that magnetic substances may be selected for the preparation of magnetic toners.

Additionally, toner and developer compositions, especially those containing charge enhancing additives, are well known, reference for example U.S. Pats. Nos. 3,893,935; 3,944,493; 4,007,293; 4,079,014 and 4,394,430. Further, there is disclosed in U.S. Pat. No. 4,338,390 developer and toner compositions having incorporated therein as charge enhancing additives organic sulfate and sulfonate substances. A similar disclosure is present in U.S. Pat. No. 4,394,430. Moreover, there are disclosed in U.S. Pat. No. 4,298,672 positively charged toner compositions with resin particles and pigment particles; and as a charge enhancing additive, alkyl pyridinium compounds, inclusive of cetyl pyridinium chloride.

Examples of toner resins described in the prior art include polyamides, epoxies, diolefins, polyurethanes, vinyl resins and polymeric esterification products of a dicarboxylic acid and a diol comprising a diphenol. Suitable vinyl resins may be selected including homopolymers or copolymers of two or more vinyl monomers. Typical vinyl monomeric units are styrene, p-chlorostyrene, unsaturated mono-olefins such as ethylene, propylene, butylene, isobutylene and the like; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate, and other similar acrylates; acrylonitrile; methacrylonitrile, acrylimide, vinyl ethers, such as vinyl methyl ether, vinyl isobutyl ether, vinyl ethyl ether, and the like; vinyl ketones such as vinyl methyl ketone, vinyl hexyl ketone, and methyl isopropenyl ketone; and N-vinyl indole, N-vinyl pyrrolidene, and the like; styrene butadiene copolymers, and mixtures thereof.

As preferred toner resins there can be selected styrene polymers and the esterification products of a dicarboxylic acid, and a diol comprising a diphenol. The aforementioned polyesters are illustrated in U.S. Pat. No. 3,590,000. Other specific preferred toner resins include styrene/methacrylate copolymers, styrene/-butadiene copolymers, polyester resins obtained from the reaction of bisphenol A and propylene oxide, followed by the reaction of the resulting product with fumaric acid, branched polyester resins resulting from the reaction of dimethyl terephthalate, 1,3-butanediol, 1,2-propanediol, and pentaerythritol; styrene butadiene copolymers prepared by a suspension polymerization process, reference U.S. Pat. No. 4,558,108, the disclosure of which is totally incorporated herein by reference.

Other representative patents primarily of background interest include U.S. Pat. No. 4,237,257 relating to methods for preparing low molecular weight styrene series polymers useful as toners, which preparation involves the selection of an organic peroxide intitiator; U.S. Pat. No. 4,339,337 relating to a suspension polymerization method for the preparation of magnetic beads from vinyl aromatic polymers, including styrenes, and where benzoyl initiators may be selected, reference column 3, line 17; and U.S. Pat. No. 4,617,249 relating to toners with a crosslinking compound, reference for example column 4, lines 42 to 64.

However, there is a need for new developer compositions that possess certain desirable characteristics, and that are useful in electrophotographic imaging systems. Additionally, there is a need for negatively charged colored developer compositions with stable triboelectric charging values and improved admix charging times. Furthermore, there is a need for negatively charged colored developer compositions wherein toner particles with an average particle diameter of from 4 to 9 microns can be formulated thereby permitting the advantages indicated herein. In addition, there is a need for resins useful for the formulation of toner compositions with specific diameters that possess desirable mechanical properties, stable electrical properties, excellent fusing characteristics, and acceptable release properties. Moreover, there is a need for developer compositions containing therein toner components illustrated herein, and carrier particles. There is also a need for imaging and printing methods wherein colored images of excellent resolution with consistent high copy quality are obtained for an extended number of imaging cycles exceeding 200,000 in some instances.

SUMMARY OF THE INVENTION

It is an object of the present invention to provide colored developer compositions with many of the above noted advantages.

In another object of the present invention there are provided negatively charged colored developer compositions containing first and second additive particles.

In still a further object of the present invention there are provided negatively charged colored developer compositions with stable triboelectric charging characteristics for an extended number of imaging cycles, and improved admixing characteristics.

Another object of the present invention resides in the provision of negatively charged colored developer compositions with certain resin particles, and carrier particles with a polymeric coating thereover thereby enabling compositions with stable triboelectric charging characteristics.

In a further object of the present invention there are provided specific negatively charged colored developer compositions wherein the toner compositions possess an average particle size diameter of from 4 to 9 microns thereby permitting increased resolution of the resulting images.

Moreover, in another object of the present invention there are provided imaging and printing methods with the colored developer compositions illustrated herein.

These and other objects of the present invention are accomplished by providing negatively charged colored developer compositions which retain their electrical characteristics for extended time periods, and wherein the compositions can be utilized in electrophotographic imaging and printing apparatus. More specifically, there are provided in accordance with the present invention negatively charged colored developer compositions comprised of resin particles including blends thereof, such as styrene butadiene resin particles, inclusive of suspension polymerized and emulsion polymerized resins as illustrated in U.S. Pats. Nos. 4,558,108 and 4,469,770, the disclosures of which are totally incorporated herein by reference, first additive collodial silica particles; second additive particles comprised of the metal salts of fatty acids or fatty acids; colored pigment particles excluding black; and coated carrier particles. Accordingly, in one embodiment of the present invention there are provided negatively charged colored developer compositions comprised of the polymerized styrene butadiene copolymer particles, or blends of the aforementioned polymers with styrene methacrylates, first external additive colloidal silica particles; second external additive particles comprised of the metal salts of fatty acids or fatty acids; pigment particles selected from the group consisting of cyan, magenta, yellow, red, blue, green, and mixtures thereof; and carrier particles comprised of a core with a coating thereover, which coating has dispersed therein conductive particles, such as carbon black.

Illustrative examples of resins selected for the toner and developer compositions of the present invention include styrene butadienes with a high percentage of styrene, such as those illustrated in the aforementioned patents. Specifically, styrene butadienes with from about 75 to about 95 percent by weight of styrene are utilized, especially suspension polymerized styrene butadienes referred to herein. Additionally, blends of styrene butadienes with other styrene polymers can be selected, which blends usually contain from about 10 to about 90 percent of styrene butadienes, and 90 to 10 percent by weight of styrene methacrylates; or styrene acrylates. Also, other mixtures of resins can be selected providing the objectives of the present invention are achievable, including those wherein the toner composition includes a mixture containing 50 percent by weight of a styrene.butyl methacrylate and 50 percent of a styrene butadiene. Of importance with respect to the toner compositions of the present invention is the average particle diameter of from 4 to 9 microns thereby enabling many of the advantages illustrated herein to achieved.

The aforementioned illustrated resins can be formulated into colored toner compositions by adding thereto pigments of cyan, magenta, yellow, red, green, blue, or mixtures thereof, and the like in an amount of from about 1 to about 20 percent by weight. Generally, these pigment particles are present in amounts of from about 1 percent by weight to about 20 percent by weight based on the total weight of the toner composition, however, lesser or greater amounts of pigment particles can be selected providing the objectives of the present invention are achieved.

Illustrative examples of cyan, magenta and yellow pigments that can be selected include, for example, 2,9-dimethyl-substituted quinacridone and anthraquinone dye identified in the Color Index as Cl 60710, Cl Dispersed Red 15, a diazo dye identified in the Color Index as Cl 26050, Cl Solvent Red 19, and the like. Illustrative examples of cyan materials that may be used as pigments include copper tetra-4-(octadecyl sulfonamido) phthalocyanine, X-cooper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected include diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl dispersed yellow 33, 2,5-dimethoxy-4-sulfonanilide phenylazo-4'-chloro-2,5-dimethoxy aceto-acetanilide, Permanent Yellow FGL; PVF Blue; Lithol Scarlett (red); Neopen Blue; and other similar compositions.

The toner and developer compositions of the present invention contain therein first and second external additive components, the first additive components being comprised of colloidal silica particles, and the second additive components being comprised of fatty acids or fatty acid metal salts thereof. Examples of silicas include Aerosil R976 and the like; while examples of the second additives are zinc stearate, calcium stearate, and the like, reference for example U.S. Pat. No. 3,320,169, the disclosure of which is totally incorporated herein by reference. These additives are usually present in an amount of from about 0.1 to about 3 percent by weight, and preferably are present in an amount of from 0.5 to about 1 percent by weight. Also, the toners with the aforementioned additives possess a triboelectric charge of from about a minus 10 to about a minus 30 microcoulombs per gram as determined in the known Faraday Cage apparatus. While it is not desired to be limited by theory, it is believed that the first additive silica particles are primarily responsible for imparting the negative triboelectric charge to the toner composition, and also enable improved powder flow and improved admixing times while the second additive particles, such as those containing zinc stearate assist in further improving the admixing characteristics.

Illustrative examples of carrier particles that can be selected for mixing with the toners of the present invention thus enabling developer compositions include those particles that are capable of triboelectrically obtaining a charge of opposite polarity to that of the toner particles which are negatively charged. Specific examples of carrier particles include steel, nickel, iron ferrites, which are preferred, reference U.S. Pat. No. 3,914,181, the disclosure of which is totally incorporated herein by reference, and the like with polymeric coatings thereover of polymethacrylates, terpolymers of styrene, methacrylate, and organosilanes, reference U.S. Pats. Nos. 3,467,634, and 3,526,533, the disclosures of which are totally incorporated herein by reference; and the like. Moreover, to enable the advantages of the present invention there are included in the polymeric carrier coating effective amounts of conductive substances, such as carbon black. In one preferred embodiment, generally the carrier coating contained a mixture of from about 10 to about 20 percent by weight of carbon black and from about 80 to about 90 percent by weight of polymers, however, other percentage mixtures can be selected providing the advantages of the present invention are achievable. Other advantages associated with the developers of the present invention include the generation of colored images with excellent color intensity for extended time periods, such as 200,000 imaging cycles.

While the diameter of the carrier particles can vary, generally they are from about 50 microns to about 250 microns, thus allowing these particles to possess sufficient density and inertia to avoid adherence to the electrostatic images during the development process. The carrier particles can be mixed with the toner composition in various suitable combinations, however, best results are obtained when about 1 part to about 10 parts toner to about 100 parts by weight of carrier are mixed.

The toner compositions of the present invention can be prepared by a number of known methods including melt blending the toner resin particles containing the pigment particles, followed by mechanical attrition, and thereafter adding thereto the first and second additive particles. Thus, in one embodiment the toner compositions are prepared by melt blending the resin particles and pigment particles, followed by micronization and classification, and thereafter adding thereto the first and second additive particles illustrated herein by simple mixing procedures. Other preparation methods can be selected such as dispersion polymerization, suspension polymerization, and extrusion processes wherein the product resulting is subjected to grinding.

Also, the toner and developer compositions of the present invention may be selected for use in developing images in electrophotographic imaging systems containing therein positively charged conventional photoreceptors, such as selenium and selenium alloys, inclusive of selenium tellurium, selenium arsenic, selenium-/arsenic/tellurium; halogen doped selenium substances; halogen doped selenium alloys, wherein the halogen is usually present in an amount of from about 200 to 700 parts per million, and the like. illustrative examples of layered photoresponsive members which can be selected for use with the toner and developer compositions of the present invention include those comprised of transport layers and photogenerating layers, reference U.S. Pat. No. 4,265,990, the disclosure of which is totally incorporated herein by reference. Examples of generating layers include trigonal selenium, metal phthalocyanines, metal free phthalocyanines, squaraine pigments and vanadyl phthalocyanines, while examples of charge transport layers include the aryl amines as disclosed in U.S. Pat. No. 4,265,990. Other photoresponsive devices useful in the present invention include polyvinylcarbazole, 4-dimethylaminobenzylidene, benzhydrazide; 2-benzylidene-aminocarbazole, 4-dimethaminobenzylidene, (2-nitro-benzylidene)-p-bromoaniline; 2,4-diphenylquinazoline; 1,2,4-triazine; 1,5-diphenyl-3-methyl pyrazoline, 2-(4'-dimethylamino phenyl)- benzoaxzole; 3-amino-carbazole, polyvinyl carbazole-trinitrofluorenone charge transfer complex; and mixtures thereof. With layered imaging members, there can be included in the toner compositions charge enhancing additives such as alkyl pyridinium halides, distearyl dimethyl ammonium methyl sulfate, and the like. These additives which are present in an amount of from about 0.1 percent to about 10 percent by weight are selected.

Of significant importance with respect to the toner compositions of the present invention are the average particle size diameters of from 4 to 9 microns, which diameters are determined by a Coulter Counter as it is primarily with these size particles that many of the advantages of the present invention are achievable.

The following examples are being supplied to further define various species of the present invention, it being noted that these examples are intended to illustrate and not to limit the scope of the present invention. Parts and percentages are by weight unless otherwise indicated.

EXAMPLE I

There was prepared by melt blending at 120° C., followed by mechnical attrition and classification, a toner composition with an average particle size diameter of 7.5 microns (6.2 volume average; 4.3 number average; as determined by a Coulter Counter) comprised of a blend of resins comprised of 5 percent by weight of a styrene n-butyl methacrylate (65/35) and 90 percent by weight of a styrene butadiene (89/11), 5 percent by weight of Hostaperm Pink, a master batch containing 50 percent by weight of magenta pigment and 50 percent by weight of a styrene n-butyl methacrylate copolymer (65/35), 0.2 percent by weight of Aerosil R976, first additive particles, and 0.5 percent by weight of second additive zinc stearate particles. Subsequently, a developer composition was prepared by admixing 2.5 parts by weight of the aforementioned prepared toner composition per 100 parts by weight of carrier particles consisting of a ferrite core with an average particle diameter of 100 microns, and a coating thereover, 0.6 percent by weight of polymethacrylate, and dispersed in the coating 20 percent of Vulcan carbon black.

Thereafter, the above prepared developer composition was incorporated into the imaging apparatus available from Xerox Corporation as the 9500, and there resulted images, magenta in color, for 150,000 imaging cycles; and wherein the triboelectric charge on the toner as determined by the known Faraday Cage process was a −25 microcoulombs per gram for 150,000 imaging cycles. Additionally, no photoreceptor filming was observed, and therefore cleaning thereof was not required for 150,000 cycles, and the images contained no background deposits thereon. The aforementioned toner had an admix time of less than 15 seconds as determined in a charge spectrograph; the images resulting contained substantially no background deposits and were substantially uniform and nongrainy. In contrast, the identical toner composition with the exception that zinc stearate was not present had a poor admix time of 5 minutes. Additionally, with out first and second additives, that is a toner composition with the identical components except that it did not contain the Aerosil and zinc stearate, and wherein the average particle diameter size was 10 microns, there resulted images with background deposits and poor image quality, which toner also had an admixing time of 5 minutes, and triboelectric charge that was not of an appropriate value to enable development for more than 50 imaging cycles.

EXAMPLE II

A toner and developer composition was prepared by repeating the process of Example I with the exception that there was selected 46.5 percent by weight of the first resin polymer particles; 46 percent by weight of the second styrene butadiene resin particles; 0.2 percent by weight of the Aerosil R976; 0.5 percent by weight of zinc stearate; and as pigment particles 7.5 percent by weight of Sudan Blue. The resulting toner had an admix time of 15 seconds, and a triboelectric charging value of a −18 to a −20 microcoulombs per gram. In addition, substantially similar imaging results were obtained when this toner was selected for the xerographic imaging test fixture of Example I.

EXAMPLE III

A toner and developer composition was prepared by repeating the process of Example I with the exception that there was selected 92.5 percent by weight of the first resin particles; 0 percent by weight of the second resin particles; 7.5 percent by weight of Sudan Blue; and as external additives 0.3 percent by weight of Aerosil R976, and 0.5 percent by weight of zinc stearate. This toner had an admixing rate of 15 seconds, and a triboelectric charge of a −20 microcoulombs per gram. Additionally, substantially similar imaging results were obtained when this toner was incorporated into the imaging test fixture of Example I.

EXAMPLE IV

A yellow toner and developer composition was prepared by repeating the process of Example I with the exception that there was selected 46.5 percent by weight of the first resin polymer particles; 46 percent by weight of the second styrene butadiene second resin particles; 7.5 percent by weight of the yellow pigment FGL; and as external additives 0.2 percent by weight of Aerosil R976, and 0.5 percent by weight of zinc stearate. This toner had a triboelectric charge of a −20 microcoulombs per gram, and an admixing time of 5 seconds. Additionally, when this toner was incorporated into the imaging test fixture of Example I substantially similar imaging results were obtained.

For each of the above Examples II to IV, the average particle diameter as determined by a Coulter Counter was substantially identical to that of Example I.

With substantially similar toner and developer compositions as detailed in Examples II to IV with the exception that the average particle diameter of the toner was 12 microns, nonuniform grainy images resulted.

Other modifications of the present invention may occur to those skilled in the art subsequent to a review of the present application, and these modifications are intended to be included within the scope of the present invention.

What is claimed is:

1. A negatively charged developer composition comprised of a toner composition with an average particle diameter of from 4 to 9 microns consisting essentially of a mixture of styrene butadienes, and styrene methacrylates; pigment particles selected from the group consisting of cyan, magenta, yellow, red, blue, green, brown, and mixtures thereof; first external additive particles of colloidal silica; second external additive particles of fatty acid metal salts; and carrier particles consisting essentially of a ferrite core with a polymeric coating thereover, which coating has dispersed therein conductive particles.

2. A composition in accordance with claim 1 wherein the mixture contains from about 10 to about 90 percent by weight of the styrene butadiene copolymer.

3. A composition in accordance with claim 1 wherein the second additive particles are comprised of zinc stearate.

4. A composition in accordance with claim 1 wherein the colloidal silica is Aerosil.

5. A composition in accordance with claim 1 wherein the first additive particles are present in an amount of from about 0.1 to about 2 percent by weight.

6. A composition in accordance with claim 1 wherein the second additive particles are present in an amount of from about 0.1 to about 2 percent by weight.

7. A composition in accordance with claim 1 wherein the carrier core consists of zinc, iron, and copper.

8. A composition in accordance with claim 1 wherein the carrier coating polymer is selected from the group consisting of polymethacrylates, and terpolymers of styrene, methacrylate, and an organo triethoxy silane; and fluoropolymers.

9. A composition in accordance with claim 1 wherein the conductive particles are comprised of carbon black.

10. A composition in accordance with claim 1 wherein the triboelectric charge on the torner is from about −20 to about −35 microcoulombs per gram.

11. A composition in accordance with claim 1 wherein the triboelectric charge on the toner is from about −20 to about −25 microcoulombs per gram for 200,000 imaging cycles.

12. A composition in accordance with claim 1 wherein the admix charging time is from about 5 to about 60 seconds.

13. A composition in accordance with claim 1 wherein the pigment particles are present in an amount of from about 1 to about 15 percent by weight.

14. A method for developing images which comprises the generation of an electrostatic latent image on an imaging member, contacting the image formed with the developer composition of claim 1, thereafter transferring the developed image to a suitable substrate, and subsequently affixing the image thereto.

15. A method of imaging in accordance with claim 14 wherein the developer composition selected retains its electrical characteristics for 200,000 imaging cycles.

16. A method of imaging in accordance with claim 14 wherein the triboelectric charge on the toner is from about −20 to about −30 microcoulombs per gram for 200,000 imaging cycles.

17. A negatively charged developer composition comprised of a toner composition with an average particle diameter of from 4 to 9 microns consisting essentially of a mixture of styrene butadienes, and styrene methacrylates; pigment particles selected form the group consisting of cyan, magenta, yellow, red, blue, green, brown, and mixtures thereof; first external additive particles of colloidal silica; second external additive particles of fatty acid metal salts; and carrier particles consisting essentially of a ferrite core with a polymeric coating thereover, which coating has dispersed therein conductive particles; subject to the provision that the resin particles comprise at least one styrene polymer.

18. A composition in accordance with claim 17 wherein the styrene polymer is styrene butadiene.

* * * * *